United States Patent [19]

Shikano et al.

[11] Patent Number: 4,806,896

[45] Date of Patent: Feb. 21, 1989

[54] ELECTROMAGNETIC SHIELD FOR ELECTROMAGNETIC APPARATUS

[75] Inventors: Yoshirou Shikano; Shinichirou Hayashi, both of Kobe, Japan

[73] Assignee: Mitsubishi Denki Kabushiki Kaisha, Tokyo, Japan

[21] Appl. No.: 218,002

[22] Filed: Jul. 13, 1988

Related U.S. Application Data

[62] Division of Ser. No. 2,365, Nov. 12, 1987, abandoned.

[30] Foreign Application Priority Data

Jan. 17, 1986 [JP] Japan ..... 61-8317

[51] Int. Cl.[4] ..... H01F 15/04; H01F 27/28

[52] U.S. Cl. ..... 336/73; 336/84 C; 336/174; 336/182; 336/184; 336/212

[58] Field of Search ..... 336/84 C, 84 R, 229, 336/212, 73, 180, 182, 183, 184, 173, 174, 175

[56] References Cited

U.S. PATENT DOCUMENTS

| | | | |
|---|---|---|---|
| 1,722,444 | 7/1929 | Reiche | 336/184 X |
| 3,453,574 | 7/1969 | DeParry | 336/229 X |
| 4,249,153 | 2/1981 | Paton et al. | 336/82 |
| 4,524,342 | 6/1985 | Mas | 336/182 |
| 4,649,639 | 3/1987 | Mas | 336/229 |

FOREIGN PATENT DOCUMENTS

| | | | |
|---|---|---|---|
| 285175 | 5/1931 | Italy | 336/73 |
| 58-124931 | 8/1983 | Japan . | |
| 86891 | 7/1936 | Sweden | 336/180 |
| 190153 | 8/1923 | United Kingdom | 336/73 |

*Primary Examiner*—Thomas J. Kozma

*Attorney, Agent, or Firm*—Sughrue, Mion, Zinn, Macpeak, and Seas

[57] ABSTRACT

An electromagnetic shield for electromagnetic apparatus comprises a plurality of shield coils (2–7) wound intermittently on a looped magnetic core (11). Same polarity terminals of the shield coils are connected to form current paths which prevent external fluxes $\phi_1$, $\phi_2$ from entering into the core.

3 Claims, 3 Drawing Sheets

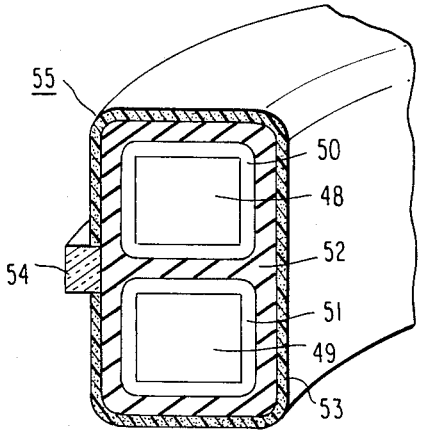
FIG. 1
PRIOR ART
FIG. 2
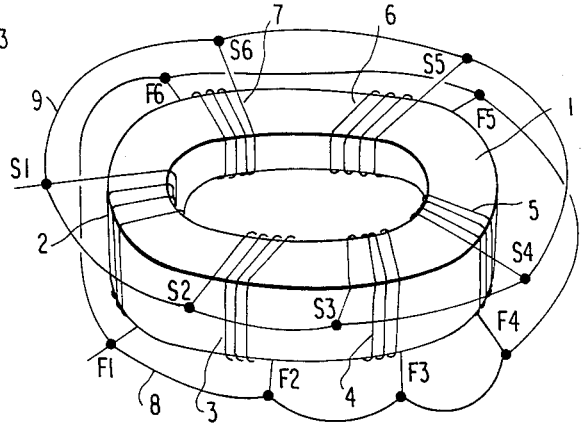
FIG. 3
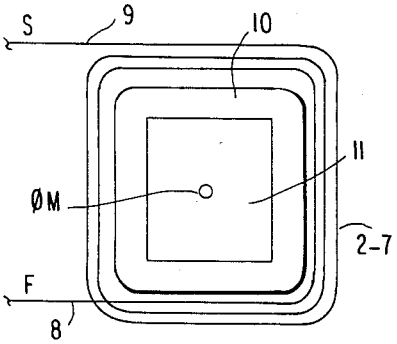
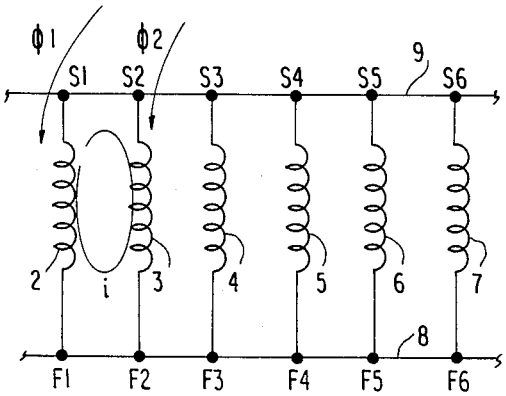
FIG. 4
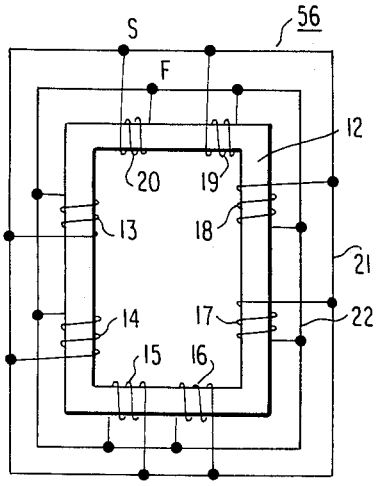
FIG. 5

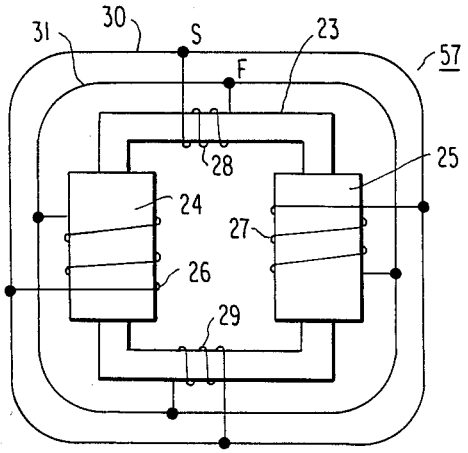
FIG.6
FIG.7
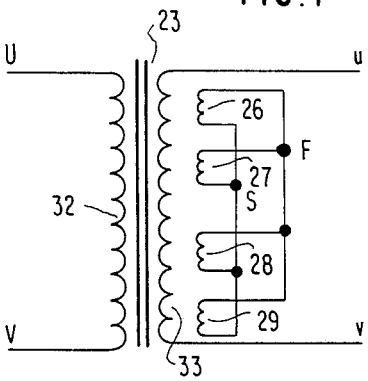
FIG.8
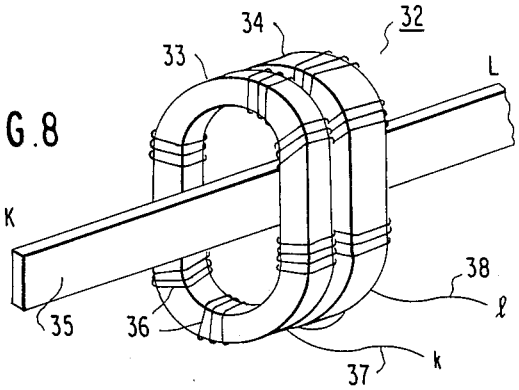
FIG.9
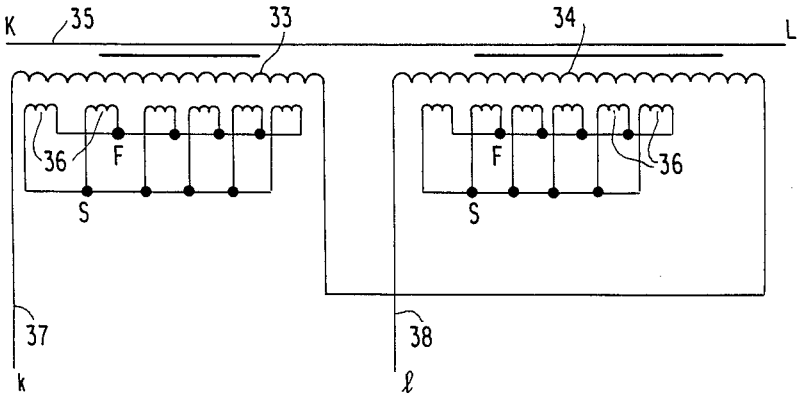

ELECTROMAGNETIC SHIELD FOR ELECTROMAGNETIC APPARATUS

This is a division of application Ser. No. 07/002,365 filed Jan. 12, 1987, now abandoned.

BACKGROUND OF THE INVENTION

This invention relates to an electromagnetic shield for an electromagnetic apparatus, such as a transformer, reactor or current transformer, to allow operation of the apparatus with high degree of accuracy by preventing any influences of external magnetic flux.

FIG. 1 is a cross sectional view of a current transformer 55 with a conventional electromagnetic shield 53, as disclosed in Japanese Utility Model Laid Open No. 58-124931.

Referring to FIG. 1, the current transformer 55 has two ring-shaped magnetic cores 48, 49 with windings 50, 51 wound thereon, respectively. The electromagnetic shield 53 which consists of electrical conductors covers the cores 48, 49 and the windings 50, 51 separated by an insulator 52. An insulator 54 is mounted externally of the electromagnetic shield 53 to prevent the shield 53 acting as one-turn short circuit inter-linked with main flux paths in the cross 48, 49. The electromagnetic shield 53 is molded with resin containing electrically conductive powder of copper or aluminum, or is made of a conductive plate of copper or aluminum.

In the current transformer 55 constituted above, the electromagnetic shield 53 does not affect the main flux flowing in the cores 48, 49. When some external magnetic flux acts on the current transformer 55, the electromagnetic shield 53 permits eddy currents to flow therein creating a magnetic field opposing the external magnetic flow fluxes and preventing any influence of the external magnetic fluxes on the windings 50, 51.

Accordingly, one is able to carry out the current measurement with sufficient accuracy without any influences of the external magnetic fluxes in such a current transformer.

In such a conventional electromagnetic shield, there are several disadvantages. When the molded resin containing electrically conductive powder is used as the electromagnetic shield 53, its performance goes down at the higher frequency range because of the specific resistance of the resin. And in the case where the shield 53 is of copper or aluminum plate, its manufacture is difficult and its cost is high because it requires making separate types of casts for each type of electromagnetic shield using special tools.

SUMMARY OF THE INVENTION

It is therefore an object of this invention to provide a new and improved electromagnetic shield for electromagnetic apparatus which is of low cost, easy to manufacture, and has sufficient shielding effect.

This object is accomplished by providing a plurality of shield coils wound on a looped magnetic core in which the main flux of the electromagnetic apparatus flows, and the same polarity ends of the shield coils are connected to each other.

BRIEF DESCRIPTION OF THE DRAWINGS

In the accompanying drawings:

FIG. 1 is a cross sectional view of a current transformer with a conventional electromagnetic shield;

FIG. 2 is a perspective view of a current transformer with an electromagnetic shield according to a preferred embodiment of this invention;

FIG. 3 is a radial cross sectional view of a portion of the current transformer in FIG. 2;

FIG. 4 is an equivalent circuit diagram illustrating the operation of the shield coils in FIG. 2;

FIG. 5 is a plan view of a current transformer with a rectangular shaped core according to a further embodiment of this invention;

FIG. 6 is a plan view of a single phase core-type transformer with an electromagnetic shield according to a further embodiment of this invention;

FIG. 7 is an equivalent circuit diagram of the transformer in FIG. 6;

FIG. 8 is a perspective view of a D.C. current transformer with an electromagnetic shield according to a further embodiment of this invention;

FIG. 9 is an equivalent circuit diagram of the D.C. current transformer in FIG. 8;

DETAILED DESCRIPTION OF THE PREFERRED EMBODIMENTS

Figure 10:
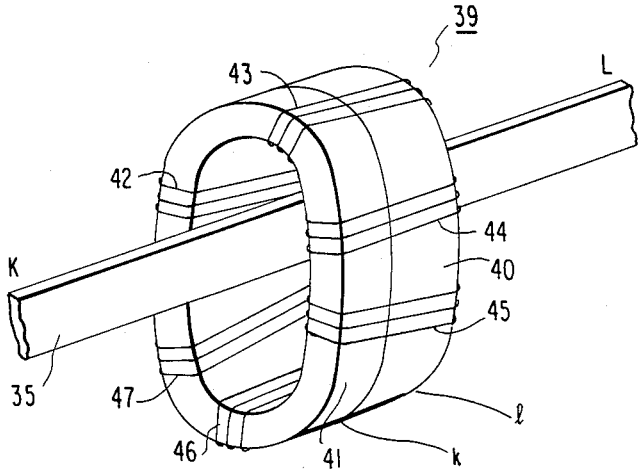
FIG. 10 is a perspective view of a D.C. current transformer with an electromagnetic shield different from that one in FIG. 9 in connection thereof.

FIG. 2 illustrates a current transformer 1 with an electromagnetic shield according to an embodiment of this invention, and FIG. 3 is a radial cross sectional view of the current transformer in FIG. 2. A secondary winding 10 of the current transformer 1 is wound uniformly on a ring-shaped core 11 wherein a main flux $\Phi M$ of the current transformer 1 flows. Six shield coils 2~7 are wound on the periphery of the secondary winding 10 at the circumferentially spaced positions. The plus polarity ends $S_1 \sim S_6$ of the shield coils 2~7 are connected to each other through a loop conductor wire 9 and minus polarity ends $F_1 \sim F_6$ of the shield coils are connected to each other through a second loop conductor wire 8.

The phenomenon produced when external magnetic fluxes are applied to the current transformer 1 via the electromagnetic shield described above will be now explained. FIG. 4 illustrates an equivalent circuit diagram. The main flux $\Phi M$ is interlinked with all of the shield coils 2~7 and includes the same voltages in all of the coils 2~7, so the main flux $\Phi M$ doesn't generate any currents in the coils 2~7. But when external fluxes $\Phi_1$ and $\Phi_2$ are applied, for example, they are interlinked with the specified shield coils and induce voltage thereacross, so that current i flows in a closed circuit consisting of shield coils 2, 3, because of the voltage difference between shield coil 2 and shield coil 3. This current i creates a flux which opposes the external fluxes $\Phi_1$ and $\Phi_2$. Then the current transformer 1 can be operated without any influence due to the external fluxes to cause errors in its operation, that is, the shield coils 2~7 supply an electromagnetic shield effect to the current transformer 1.

FIG. 5 illustrates a current transformer 56 with a rectangular shaped core 12 according to a further embodiment of this invention. Eight shield coils 13~20 are wound on the sides of the core 12, and their starting ends are connected to each other through a loop conductor wire 21 and their finishing ends are connected each other through a further loop conductor wire 22.

FIG. 6 illustrates a single phase core-type transformer 57 with an electromagnetic shield according to another embodiment of this invention. Transformer windings 24, 25 are wound on parallel leg portions of the core 23, respectively. In this case, the electromagnetic shield consists of shield coils 26, 27 wound on the periphery of the transformer windings 24, 25 and shield coils 28, 29 wound on the yoke portions of the core 23. Both ends of the shield coils S. F are connected to each other through respective loops wires 30, 31 same as above embodiments.

FIG. 7 shows an equivalent circuit of the transformer in FIG. 6, and illustrates the relation between its primary winding 32, secondary winding 33 and the shield coils 20~29.

FIG. 8 illustrates a D.C. current transformer 32 with an electromagnetic shield according to a further embodiment of this invention. The D.C. current transformer 32 has two windings 33, 34 wound on looped cores respectively through which primary conductor 35 extends. Windings 33, 34 are supplied by lines 27, 28. Detective current flows out of the winding ends k, λ. Shield coils 36 are wound on the periphery of each winding, at circumferentially spaced positions.

FIG. 9 is an equivalent circuit of the D.C. current transformer in FIG. 8.

FIG. 10 also illustrates a D.C. current transformer 39 which is of the same construction as the current transformer in FIG. 8 except shield coils 42~47 are wound on the periphery of the side by side abutting windings 40, 41.

Figure 11:
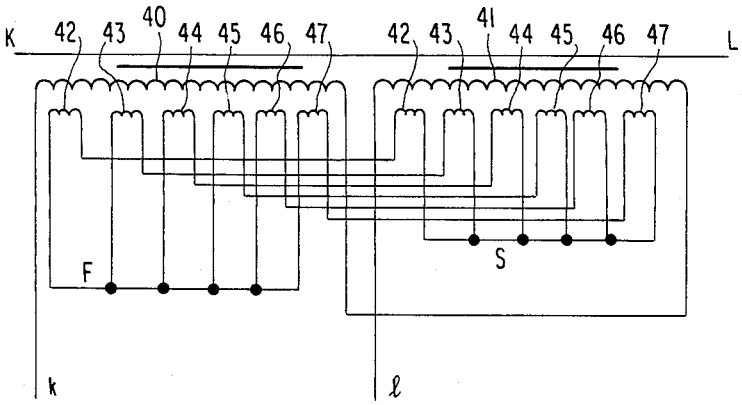
FIG. 11 is an equivalent circuit diagram of the D.C. current transformer in FIG. 10.

FIG. 11 is an equivalent circuit of the D.C. current transformer in FIG. 10.

Within the respective drawings for the multiple embodiments illustrated, like elements bear like numerical designations.

What is claimed is:

1. An electromagnetic shield in an electromagnetic apparatus comprising a DC current transformer having two looped magnetic cores which are interlinked with a primary conductor and secondary windings wound on the cores individually, a plurality of shield coils wound at circumferentially, equally spaced positions on said looped magnetic cores in which a main flux of said electromagnetic apparatus flows, a first short circuit means for short-circuiting the plus polarity terminals of said shield coils to each other, and a second short circuit means for short-circuiting the minus polarity terminals of said shield coils to each other.

2. An electromagnetic shield according to claim 1, wherein said shield coils form two groups of coils, one group of which is wound on one of said cores and another group of which is wound on another of said cores.

3. An electromagnetic shield according to claim 1, wherein said cores are in side by side abutment and said shield coils are each wound about both said cores.

* * * * *